US012521592B2

(12) United States Patent
Ross

(10) Patent No.: US 12,521,592 B2
(45) Date of Patent: Jan. 13, 2026

(54) TRAINING APPARATUS

(71) Applicant: Innovative Baseball Concepts, Ltd., Hudson, OH (US)

(72) Inventor: Stephen Ross, Las Vegas, NV (US)

(73) Assignee: Innovative Baseball Concepts, Ltd., Hudson, OH (US)

( * ) Notice: Subject to any disclaimer, the term of this patent is extended or adjusted under 35 U.S.C. 154(b) by 460 days.

(21) Appl. No.: 17/701,807

(22) Filed: Mar. 23, 2022

(65) Prior Publication Data

US 2022/0305361 A1 Sep. 29, 2022

Related U.S. Application Data

(60) Provisional application No. 63/164,588, filed on Mar. 23, 2021.

(51) Int. Cl.
*A63B 21/015* (2006.01)
*A63B 21/00* (2006.01)
(Continued)

(52) U.S. Cl.
CPC ..... *A63B 21/015* (2013.01); *A63B 21/00069* (2013.01); *A63B 21/4035* (2015.10);
(Continued)

(58) Field of Classification Search
CPC ..... A63B 21/015; A63B 21/00069; A63B 21/4035; A63B 23/14; A63B 43/02;
(Continued)

(56) References Cited

U.S. PATENT DOCUMENTS 3,184,234 A * 5/1965 Struble ..... A63B 23/14 482/118
3,830,493 A * 8/1974 Miller ..... A63B 23/14 482/46

(Continued)

FOREIGN PATENT DOCUMENTS

CN 102481468 A 5/2012
CN 203408439 U 1/2014

(Continued)

OTHER PUBLICATIONS

The International Search Report and the Written Opinion of the International Searching Authority for corresponding patent application No. PCT/US2022/021457, dated Mar. 23, 2022, 12 pages.

(Continued)

*Primary Examiner* — Megan Anderson
*Assistant Examiner* — Catrina A Letterman
(74) *Attorney, Agent, or Firm* — Tucker Ellis LLP; Michael G. Craig

(57) ABSTRACT

A training apparatus for training a user's grip and strength. A rod element is disposed through a female tube that is disposed at a first end of the rod. The rod extends through a male tube that is inserted into at least a portion of the female tube. A grommet is disposed on the rod, inside the female tube, and abutting the male tube. A fastening means couple to the first end of the rod, mitigating movement of the grommet toward the first end. A tensioner is rotatably attached to a second end of the rod, wherein when the tensioner is rotated clockwise it presses the male tube forward against the grommet, which is compressed between the male tube and fastening means, expanding inside the female tube. The grommet pressing against the inside of the female tube provides a desired resistance for a user rotating an attached training member.

20 Claims, 3 Drawing Sheets

(51) Int. Cl.
*A63B 23/14* (2006.01)
*A63B 43/02* (2006.01)
*A63B 69/00* (2006.01)

(52) U.S. Cl.
CPC ..... *A63B 23/14* (2013.01); *A63B 43/02* (2013.01); *A63B 69/0002* (2013.01)

(58) Field of Classification Search
CPC ..... A63B 69/0002; A63B 21/0023; A63B 21/023; A63B 21/05; A63B 21/4049; A63B 23/03533; A63B 23/12
See application file for complete search history.

(56) References Cited

U.S. PATENT DOCUMENTS 4,643,417 A * 2/1987 Nieman ..... A63B 21/00069 482/46
4,838,542 A * 6/1989 Wilkinson ..... A63B 21/075 482/45
5,184,986 A * 2/1993 Wilkinson ..... A63B 23/14 482/118
5,776,034 A * 7/1998 Stamler ..... A63B 23/14 482/45
6,138,879 A * 10/2000 Breuner ..... A63B 43/02 223/78
6,398,694 B1 * 6/2002 Bountourakis .. A63B 21/00069 601/134
2010/0267523 A1 * 10/2010 Wilkinson ..... A63B 21/0726 482/45
2012/0152872 A1 6/2012 Didehvar
2013/0331234 A1 * 12/2013 Niederman ..... A63B 21/4035 482/46
2022/0355149 A1 * 11/2022 Nieman ..... A63B 21/05

FOREIGN PATENT DOCUMENTS

KR 20-2016-0002862 U 8/2016
KR 10-2019-0053580 A 5/2019

OTHER PUBLICATIONS

Supplementary European Search Report for corresponding patent application No. PCT/US2022/021457, dated Dec. 3, 2024, 8 pages.

* cited by examiner

TRAINING APPARATUS

CROSS-REFERENCE TO RELATED APPLICATIONS

This application claims priority to U.S. provisional patent application Ser. No. 63/164,588, entitled TRAINING APPARATUS, filed Mar. 23, 2021, all of which is incorporated herein by reference.

BACKGROUND

Typically, physical therapy, athletic/physical fitness training, and sports training involves conventional strengthening and flexibility exercises in order to improve the performance of an athlete. Often, stretching, weight lifting, and other exercises may be used during training. Although these exercises may help to improve performance, the athlete does not have the ability to train with the proper hand placement in sports which utilize a ball or another object requiring a certain grip or hold. Such sports may include baseball, softball, football, disc golf, darts, racquetball, golf, hockey, lacrosse, tennis, badminton, shot put, bowling, dodgeball, and the like.

In view of these challenges with conventional exercises and exercise devices, the need therefore remains for improved training in which the forearm, wrist, and/or hand is strengthened with a ball or other object used in the sport or activity that is adjustable as well as other advantages. There is also a need for a method to use such a training apparatus.

SUMMARY

The present disclosure relates generally to the field of devices for use in training for physical therapy, athletic/physical fitness training, and sports training such as baseball, softball, football, disc golf, darts, racquetball, golf, hockey, lacrosse, tennis, badminton, shot put, bowling, dodgeball, and the like for teaching proper technique, developing motor memory, and strengthening muscles through resistance training for activities that use the forearm, wrist and/or hand.

The embodiments of what is described herein are not intended to be exhaustive or to limit what is provided in the claimed subject matter and disclosed in the detailed description. Rather, the embodiments are chosen and described so that others skilled in the art may appreciate and understand the principles and practices of what is provided in the claimed subject matter.

A training apparatus as shown and described herein.

Additionally, a training apparatus comprising: 1) a central rod element comprising a first end and a second end, wherein the first end has a first tip; 2) a female tube extending along the axis of the central rod element and located at the first end of the central rod element; 3) a male tube comprising at least one bearing surface (e.g., a first bearing surface and a second bearing surface) and extending along the axis of the central rod element at least partially between the first end of the central rod element and the second end of the central rod element wherein the male tube is inserted into at least a portion of the female tube; 4) a grommet at the first end of the central rod element, wherein the grommet at least partially contacts an interior portion of the female tube, such as an inner bearing surface; 5) a fastening means on the first tip on the first end of the central rod element, wherein the fastening means is at least partially fastened to the central rod element; 6) a rolling element at the second end of the central rod element, wherein the rolling element at least partially contacts an interior portion of the male tube; and 7) a tensioner rotatably attached to the second end of the central rod element and pressed against the rolling element, wherein the tensioner, the central rod element, and the female tube are rotated clockwise and the grommet is compressed between the male tube and fastening means.

The training apparatus may further comprise an overmold at least partially disposed on the male tube. The training apparatus may also further comprise a mounting clip at least partially disposed on the female tube. In some embodiments, the mounting clip further comprises a male connector.

The training apparatus may further comprise training member, wherein the training member comprises a training member insert with a female connector and is configured for mounting to the first end of the male connector of the mounting clip.

For the training apparatus, the tensioner, the central rod element, and the female tube are rotated counter-clockwise and the grommet may be decompressed between the male tube and fastening means. In some embodiments, the grommet is rubber.

The training apparatus may further comprise a texturized surface on the interior portion of the female tube.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

These and other features, aspects and advantages are better understood when the following detailed description is read with reference to the accompanying drawings, in which.

DETAILED DESCRIPTION

Aspects of what is described herein are disclosed in the following description related to specific embodiments. Alternative embodiments may be devised without departing from the scope of what is described herein. Additionally, well-known embodiments of what is described herein may not be described in detail or will be omitted so as to not obscure the relevant details of what is described herein. Further, to facilitate an understanding of the description, discussion of several terms used herein follows.

As used herein, the word "exemplary" means "serving as an example, instance, or illustration." The embodiments described herein are not limiting, but rather exemplary only. It should be understood that the described embodiments are not necessarily to be construed as preferred or advantageous over other embodiments. Moreover, the term "embodiment (s)" does not require that all embodiments include the discussed feature, advantage, or mode of operation.

The present disclosure relates generally to exercise assemblies, namely training apparatus like pitching, throwing, and grip trainers, that, when used for various products, provide advantageous improvements over current exercise and training equipment. These improvements for the training apparatus described herein may include improved for teaching proper technique, developing motor memory, and strengthening muscles through resistance training for sports and other activities that use the forearm, wrist, and/or hand. These activities may include, but are not limited to baseball, softball, football, disc golf, darts, racquetball, golf, hockey, lacrosse, tennis, badminton, shot put, bowling, and dodgeball. Specifically, the training apparatus described herein provides a simulated training member that is similarly shaped like the sport or activity where training is desired. In holding or gripping the training member of the training apparatus described, the user may exercise and train the forearm, wrist, and/or hand in the actual position used in the sport or other activity. Additionally, the training apparatus described may be adjusted to provide various resistance levels for training requirements, as well as other advantages.

Figure 1:
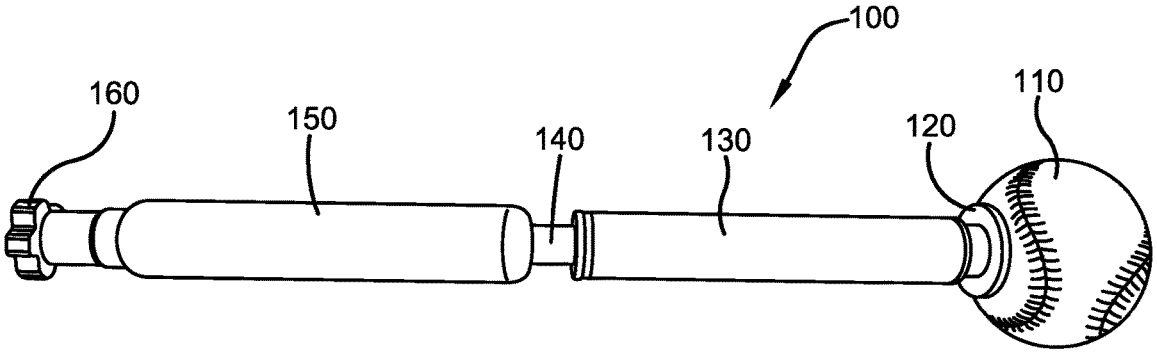
FIG. 1 illustrates a front view of a training apparatus in accordance with embodiments of the disclosure.
Figure 2:
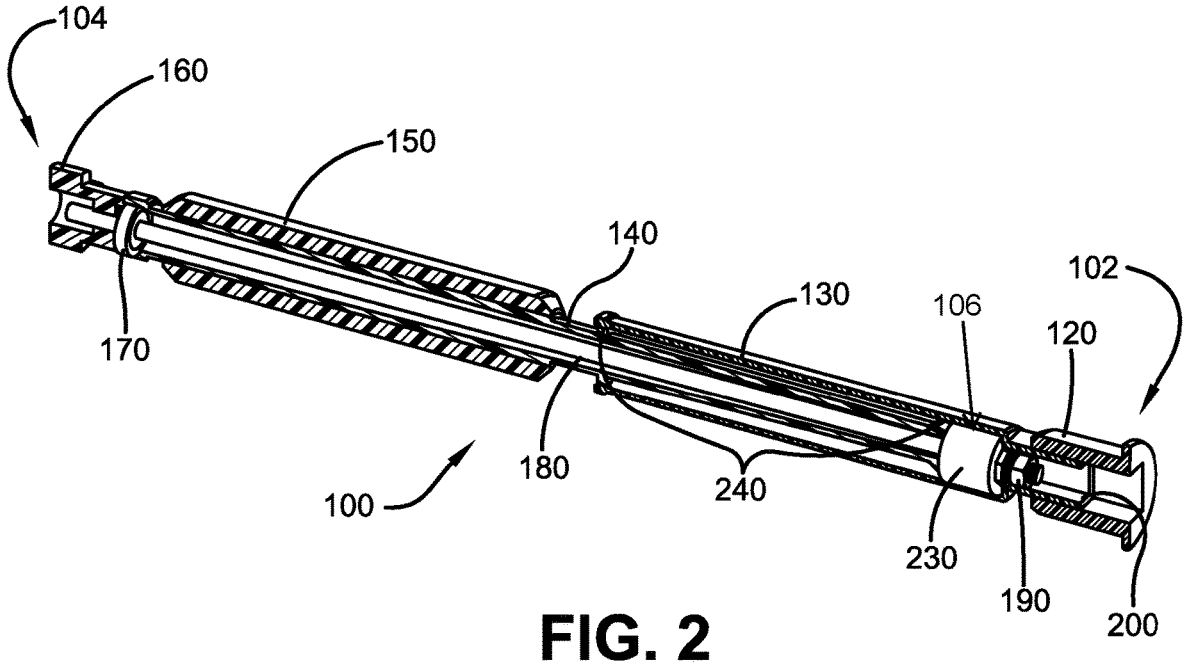
FIG. 2 is a component diagram illustrating a cross-sectional view of the first arm of the training apparatus.
Figure 3:
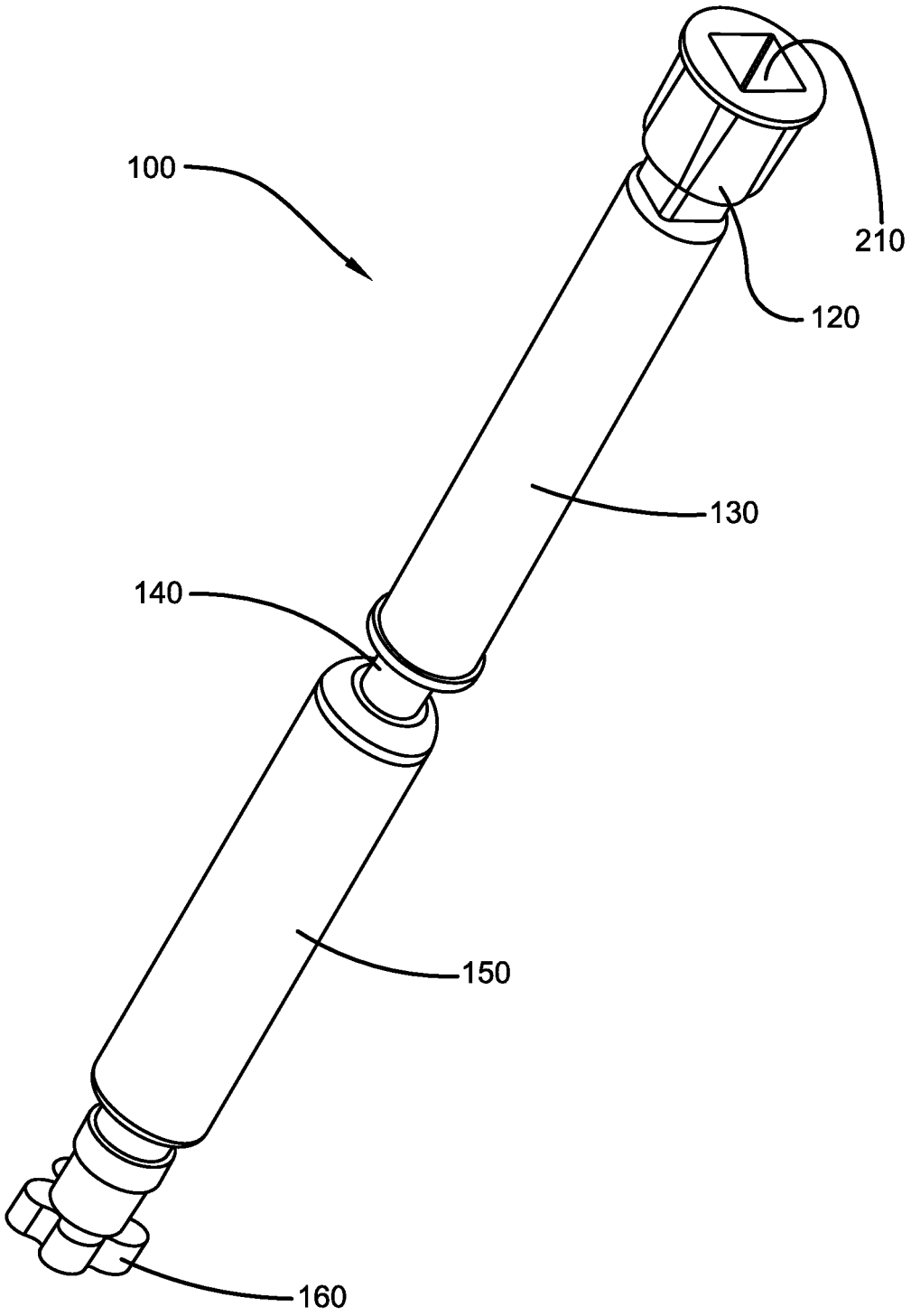
FIG. 3 is a side perspective view of the training apparatus.

FIGS. 1-3 illustrate the training apparatus in one implementation, as shown and described herein.

Referring to FIG. 1, a front view of the training apparatus 100 is shown. The training apparatus 100 includes a first tube 130 (e.g., female tube), a second tube 140 (e.g., male tube), an overmold 150 (e.g., grip or gripping portion), a tensioner element 160, a mounting clip 120, and a training member 220 (described further in FIG. 4). As shown in FIG. 1, in one implementation, the training member 220 can comprise a ball, such as a baseball. The training apparatus 100 may provide a user with a means to exercise and train the shoulder, forearm, wrist, and/or hand using the training member 220 corresponding to a particular sport or other activity (e.g., physical therapy, fitness training). In many embodiments, one hand of the user is placed on the training member 220 in the appropriate position for the sport or other activity while the other hand of the user is placed on the overmold 150 (e.g., fashioned as a grip, or with grip improvement material) to operably stabilize the training apparatus 100 such that a user can exercise and train targeted portions of the user's body using the tension of the training apparatus 100. In many embodiments, a user may repetitively exercise at a preset resistance (e.g., tension) of the training apparatus 100 in order to improve shoulder, forearm, wrist, and/or hand strength for a particular sport or activity using a particular position of the forearm, wrist, and/or hand on the training member 220.

Referring to FIG. 2, a cross-sectional view of the training apparatus 100 is shown. The training apparatus 100 comprises a centrally disposed rod (180) (e.g., central rod element, that can be at least a partially threaded rod) comprising a first end 102 and a second end 104. In some implementations, the rod 180 can be at least partially threaded, for example, comprising screw threading at least at the first end 102, and/or the second end 104. In other implementations, the rod may also be threaded along the entire length. The training apparatus 100 also comprises a first (e.g., female) tube 130 extending along the axis of the rod 180 and located at the first end 102 of the rod 180. Further, a second (e.g., male) tube 140 comprises at least one bearing surface 240 (e.g., a first bearing surface and a second bearing surface) and extends along the axis of the rod 180 at least partially between the first end 102 and the second end 104. The second tube 140 is inserted into at least a portion of the first tube 130. Additionally, a grommet 230 is disposed at the first end 102 of the rod 180, wherein the grommet 230, in operation (e.g., under compression), can at least partially contact an interior portion of the first tube 130 along an inner bearing surface 106. A compressing element 190 can comprise a body that is operably disposed at the first end 102 of the rod 180, wherein the compressing element 190 is at least partially fastened to the rod 180 (e.g., a nut threaded onto the rod). A bearing 170 is disposed at the second end 104 of the rod 180, wherein the bearing 170 can at least partially contacts an interior portion of the second tube 140. A tensioner 160 can be fixedly engaged to the second end 104 of the rod 180, and may be in contact with the bearing 170.

Operationally, in some implementations, the tensioner 160, the rod 180, and the first tube 130 can be rotated (e.g., clockwise or counterclockwise), resulting in the grommet 230 being compressed between the second tube 140 and fastening means 190. That is, for example, the tensioner 160 can be threadedly engaged with the rod 180 at the second end 104. In this example, when the tensioner is rotated to advance along the rod threads toward the first end 102, it engages with the second tube 140 at the second end 104, this results in the second tube pressing against the grommet 230 at the inner bearing surface 106, by compressing and deforming the flexible material (e.g., a polymer compound) comprising grommet. In this example, the body of the compressing element 190 mitigates movement of the grommet 230 toward the first end 102, resulting in the grommet being squeezed between a first bearing surface 240 of the second tube 140 and the compression element 190.

In some implementations, the grommet 230 can be formed from an elastomeric material, such as a polymer, rubber, silicone, and combinations thereof, which allow it to deform under pressure, and return to shape when the pressure is released. In this implementation, the grommet 230 is placed under pressure by the first bearing surface 240 of the second tube 140 and compression element 190, resulting in its deformation inside first tube 130, thereby pressing against the inside walls of the first tube 130 at the inner bearing surface 106. For example, a greater amount of pressure applied by the second tube bearing surface 240, provided by the rotation of the tensioner 160 toward the first end 102, the greater amount of deformation results. In this way, for example, an amount of pressure applied to the inside walls of the first tube 130 can be adjusted according to a desired resistance (e.g., more pressure=increased deformation=more tension against the inner bearing surface 106 of the first tube 130).

In many embodiments, the training apparatus 100 functions by the assembly of the second tube 140 at least partially inside the first tube 130, axially separated by a grommet 230 on the first end 102 of the rod 180, where the grommet 230 may be compressed against an inner wall of the first tube 130 and the end of the second tube 140. The compression of the grommet 230 and resulting force may occur during rotation of the second tube 140 with respect to the first tube 130.

In many embodiments, the training apparatus comprises a centrally disposed rod 180 (e.g., partially threaded rod element). The rod 180 can be comprised of plastic, metal, wood, polymer, carbon, or combinations thereof. In some embodiments, the rod 180 may be at least partially threaded. In one embodiment, the rod 180 may be at least partially threaded on the first end 102. In one embodiment, the rod 180 may be at least partially threaded on the second end 104. In one embodiment, the central rod element is not threaded.

In many embodiments, the first tube 130 at the first end 102 of the rod 180 can be comprised of an appropriate material, such as polymer, plastic, metal, wood, graphite, carbon, resins, or combinations thereof. In one embodiment, the interior portion of the first tube 130 can comprises a smooth surface. In some embodiments, the training apparatus 100 further comprises a texturized surface on the interior portion of the first tube 130. For the training apparatus 100, the grommet 230 may be mitigated from rotating with respect to the first tube 130 by the texturized surface on the interior portion of the first tube 130 (e.g., at the inner bearing surface 106). In some embodiments, the texturized surface on the interior portion of the first tube 130 may include dimples, a textured patterned, or otherwise roughened surface.

In many embodiments, the second tube 140 at the second end 104 of the rod 180 comprised of an appropriate material, such as polymer, plastic, metal, wood, graphite, carbon, resins, or combinations thereof. The second tube 140 may comprise at least one bearing surface 240 on the end of the second tube 140. At least one bearing surface 240 may be a raised edge, lip, or step that may further serve to stabilize or position the outside portion of the second tube 140 with respect to the interior portion of the first tube 130. Further, at least one bearing surface 240 on the second tube 140 may mitigate movement of the first tube 130 off-axis during use of the training apparatus 100. In some embodiments, there is one bearing surface 240. In some embodiments, at least one bearing surface 240 may include two ring-like or raised surfaces: one near the middle of the second tube 140 to at least partially secure the second tube 140 to the first tube 130, and another at the end of the second tube where it presses against the grommet 230.

In many embodiments, in operation, the grommet 230 can at least partially contact an interior portion of the first tube 130. In some embodiments, the grommet 230 may compress against the interior portion of the first tube 130. In many embodiments, the grommet 230 is rubber. In other embodiments, the grommet 230 is plastic. In one embodiment, the grommet 230 is a flexible plastic.

In many embodiments, the training apparatus 100 may be adjusted to provide a desired resistance for a user. To increase resistance, the tensioner 160 may be rotated in a first direction (e.g., clockwise), which results in the pressing of the first bearing surface 240 of the second tube 140 against the grommet 230 at a first side, and against a stationary fastening means 190 at a second side, resulting in the compression of the grommet 230, and expansion of the diameter of the grommet 230, thereby pressing the grommet against the inside wall of the first tube 130 (grommet shown as 230 in FIG. 2). That is, for example, the grommet 230 expands against the inside wall of the first tube 130, providing frictional resistance. To decrease resistance, the tensioner 160 may be rotated in a second direction (e.g., counter-clockwise), moving the bearing surface 240 of the second tube 140 away from the grommet inside of the first tube 130 (grommet shown as 230 in FIG. 2), which contracts from the inside wall of the first tube 130, decreasing the diameter of the grommet 230, thereby decreasing frictional resistance.

For the training apparatus 100, the compression of the grommet 230, and hence, the resistance provided by the adjustable friction force during rotation of the second tube 140 with respect to the first tube 130, may be adjusted using the tensioner 160. In many embodiments, the tensioner 160 may be rotated to adjust the position of the tensioner with respect to the rod 180, or to adjust the position of the fastening means 190 with respect to the rod 180. That is, the tensioner 160 can be fixed to the second end 104 of the rod 180, and rotated to threadedly translate the compression element 190 (e.g., a threaded nut) toward the second end 104. Alternately, the tensioner 160 can be threadedly engaged with the second end 104 of the rod 180. When the tensioner is rotated in the first direction the tensioner 160 translates toward the first end 102, thereby forcing the second tube 140 toward the first end 102, through first tube 130, forcing the second tube bearing surface 240 against the grommet 230. In some embodiments, the tensioner 160 may contact the bearing 170 to assist in rotation along the rod 180. As such, for example, the tensioner 160 can be rotated clockwise, forcing the grommet 230 to be compressed between the second tube 140, and fastening means 190. In some embodiments, the axial loading of the grommet 230 may be constant.

In many embodiments, the training apparatus 100 further comprises an overmold 150 or grip that is at least partially disposed on the second tube 140. The overmold 150 serves to provide a grip portion for the user while training and exercising. In some embodiments, the overmold 150 is a foam. In other embodiments, the overmold 150 is a plastic. In one embodiment, the overmold 150 is a smooth plastic. In one embodiment, the overmold 150 is a textured plastic, or shaped to provide improved gripping by a user. Other materials for the overmold 150 are also contemplated, such as natural materials (e.g., animal or vegetable leathers).

As shown in FIG. 2, the tensioner 160 is provided to at least partially contact the bearing 170. In some embodiments, the tensioner 160 is rotated clockwise to provide more tension for the training apparatus 100. In other embodiments, the tensioner 160 is rotated counter-clockwise to provide less tension for the training apparatus 100. In many embodiments, the tensioner 160 may be plastic, metal, wood, or combinations thereof. Other materials are also contemplated. For the bearing 170, the tensioner 160 may at least partially contact an inter race or groove in the bearing 170. In some embodiments, the bearing 170 is a ball bearing series in a raceway. Other types of bearings 170 may also be contemplated. In some embodiments, the bearing 170 may be omitted from the training apparatus 100.

In many embodiments, the training apparatus 100 comprises a compression element 190, such as a fastening means. The compression element 190 may comprise, but is not limited to, at least one nut, washer (including lock washer), bolt, and combinations thereof. Other compression element 190 are also contemplated. For the training apparatus 100, the rod 180 may be at least partially positioned by the compression element 190 that are at least partially connected to the inner wall of the first tube 130. In some embodiments, the first end 102 of the rod 180 may include at least one set of nuts and washers that are secured to the inner wall of the first tube 130. In some embodiments, the washers may be lock washers. In one embodiment, the rod 180 may include two sets of nuts and lock washers that are secured to the inner wall of the first tube 130.

In many embodiments, the training apparatus 100 further comprises a mounting clip 120 at least partially disposed on the first tube 130. In some embodiments, the mounting clip 120 may be fixedly attached to the first tube 130. In other embodiments, the mounting clip 120 may be selectably removeably attached to the first tube 130. In many embodiments, the mounting clip 120 may be plastic, metal, wood, graphite, polymer, or combinations thereof. Other materials are also contemplated.

As shown in FIG. 3, another view of the training apparatus 100 is provided where the second tube 140, first tube 130, tensioner 160, and overmold 150 are shown. In many embodiments, the training apparatus 100 further comprises a mounting clip 120 selectably disposed on the first tube 130. FIG. 3 also provides a view of the mounting clip 120, as also shown in FIG. 2.

In some embodiments, the first end 102 of the training apparatus 100 further comprises a male connector 200. The male connector 200 provides a means in which the training member 110 may be selectably attached to the rest of the training apparatus 100. In another embodiment, the male connector 200 may selectably, fixedly attach to the female connector 210 of the training member 110, providing a permanent and non-removable training member 110 on the training apparatus 100 for users.

In some embodiments, the male connector 200 may be shaped to connect to the female connector 210 (described in FIG. 4) in operable engagement, such as in a friction fit, or using stops and ridges disposed on the inside of the female connector 210 and/or the outside of the male connector 200. Alternatively or in addition, the male connector 200 may include at least one thread that may be screwed into the female connector 210 (described in FIG. 4) also including at least one thread in order to secure the training member 110 to the training apparatus 100.

Although FIG. 3 illustrates the female connector 210 comprising in a square shape opening that couples with a male connector 200 in a complementary shape. Other shapes like rectangle, circle, oval, and the like are also contemplated. An irregular shape may also be used for the male connector 200 and female connector 210.

Figure 4:
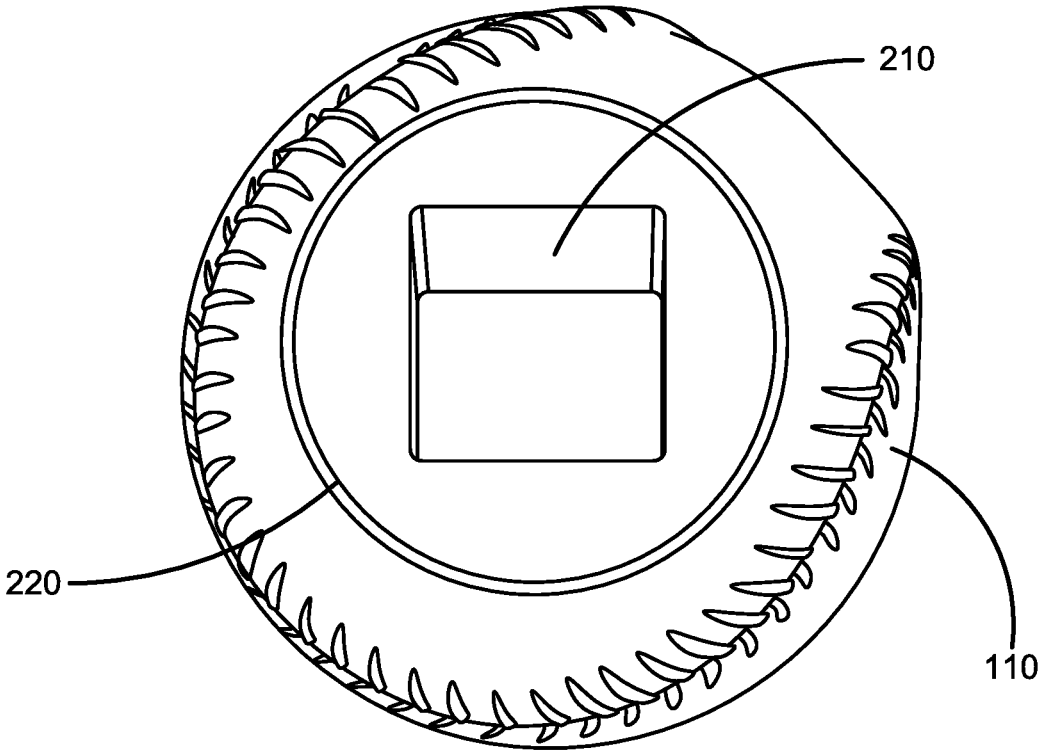
FIG. 4 is a front view of a portion of the training member.

As shown in FIG. 4, a training member 110 is provided. In many embodiments, the training apparatus 100 further comprises a training member 110. In many embodiments, the training member 110 comprises a training member insert 220 comprising a female connector 210 and is configured for mounting to the first end 102 of the male connector 200. Although the training member 110 is shown as a ball (e.g., baseball), other sports and activities may include baseball, softball, football, disc golf, darts, racquetball, golf, hockey, lacrosse, tennis, badminton, shot put, bowling, cricket, and dodgeball. Other shapes and sizes for other sports and activities are contemplated, such as those that can accommodate a gripped portion of a porting or training apparatus (e.g., ball, club, bat, etc.).

In order to be mounted onto the training apparatus 100 (shown in FIGS. 1-3), the training member 110 may include a training member insert 220 and a female connector 210. The shapes and sizes of the training member insert 220 and female connector 210 are not limited, but the female connector 210 of the training member 110 is sized and configured to receive the male connector 200 (shown in FIG. 2) such that the training member 110 may be selectably, detachably attached to the training apparatus 100. Because the training member 110 is detachably attached to the training apparatus 100, various training members 110 may be used on a training apparatus 100.

The training member insert 220 is fixedly attached to and positioned within the training member 110. In some embodiments, the training member insert 220 may be flush with the surface of the training member 110. In other embodiments, the training member insert 220 may not be flush with the surface of the training member 110. In some embodiments, the training member insert 220 may be positioned within a portion of the training member 110. In other embodiments, the training member insert 220 may be positioned completely through the training member 110. The training member insert 220 may be comprised of wood, plastic, metal, or any other material that may facilitate a connection to the training apparatus 100.

In some embodiments, the female connector 210 may be shaped to receive the male connector 200. Alternatively or in addition, the female connector 210 may include at least one thread in which the male connector 200 also including at least one thread may be screwed into the female connector in order to secure the training member 110 to the training apparatus 100. Although FIG. 4 illustrates the female connector 210 in a square shape, other shapes like rectangle, circle, oval, and the like are also contemplated. An irregular shape for the female connector 210 may also be used.

In some embodiments, one or more portions of the training apparatus 100 can be made by 3-D printing. In other embodiments, the training apparatus 100 can be formed, such as using molding operations (e.g., form, injection, blow, casting, etc.), milling, stamping, or otherwise shaping the components.

Further disclosed is a method of training with the training apparatus comprising: 1) a centrally disposed rod element comprising a first end and a second end; 2) a first tube extending along the axis of the rod element and located at the first end of the rod element; 3) a second tube comprising at least one bearing surface and extending along the axis of the rod element at least partially between the first end of the rod element and the second end of the rod element wherein the second tube is inserted into at least a portion of the first tube; 4) a grommet at the first end of the rod element, wherein the grommet operably, at least partially contacts an interior portion of the first tube; 5) a compression element at the first end of the rod element, wherein the body compression element is at least partially fastened to the rod element; 6) a bearing at the second end of the rod element, wherein a second bearing surface at least partially contacts an interior portion of the second tube; and 7) a tensioner rotatably attached to the second end of the rod element and pressed against the bearing, wherein the tensioner, the rod element, and the first tube are rotated clockwise and the grommet is compressed between the second tube and compression element.

Embodiments

The following embodiments are contemplated. All combinations of features and embodiments are contemplated.

Embodiment 1: A training apparatus as shown and described.

Embodiment 2: A training apparatus comprising: 1) a central rod element comprising a first end and a second end, wherein the first end has a first tip; 2) a first tube extending along the axis of the central rod element and located at the first end of the central rod element; 3) a second tube comprising at least one bearing surface and extending along the axis of the central rod element at least partially between the first end of the central rod element and the second end of the central rod element wherein the second tube is inserted into at least a portion of the first tube; 4) a grommet at the first end of the central rod element, wherein the grommet at least partially contacts an interior portion of the first tube; 5) a fastening means on the first tip on the first end of the central rod element, wherein the fastening means is at least partially fastened to the central rod element; 6) a bearing at the second end of the central rod element, wherein the bearing at least partially contacts an interior portion of the second tube; and 7) a tensioner rotatably attached to the second end of the central rod element and pressed against the bearing, wherein the tensioner can be rotated with respect to the central rod element, resulting in the grommet being compressed between the second tube and fastening means.

Embodiment 3: The training apparatus of Embodiment 2 further comprising an overmold/grip assembly at least partially disposed in a fixed engagement on the second tube.

Embodiment 4: The training apparatus of any of Embodiments 2 or 3 further comprising a mounting clip at least partially disposed in a selectable engagement on the first tube.

Embodiment 5: The training apparatus of Embodiment 4, wherein the mounting clip further comprises a male connector.

Embodiment 6: The training apparatus of any of Embodiments 2-5 further comprising a training member, wherein the training member comprises a training member insert with a female connector and is configured for mounting to the first end of the male connector of the mounting clip.

Embodiment 7: The training apparatus of any of Embodiments 2-6, wherein the tensioner (e.g., and sometimes the central rod element) is rotated counter-clockwise and the grommet is decompressed between the second tube and fastening means.

Embodiment 8: The training apparatus of any of Embodiments 2-7, wherein the grommet is rubber, a polymer, or silicone, or combinations thereof.

Embodiment 9: The training apparatus of any of Embodiments 2-8 further comprising a texturized surface on the interior portion of the first tube.

In some implementations, in operation, the tensioner can be rotated in a first direction (e.g., tightening) to compress the grommet against the inside wall of the first (female) tube; or in a second direction to decompress the grommet against the inside wall of the first (female) tube to a desired preset resistance applied to the first tube. Further, in this implementation, a desired training member (e.g., training ball or other shape), comprising a female connector, can be attached to the male connector disposed at the second end of the first tube. As an example, one the training member has been attached, and the desired resistance has been achieved, training apparatus can be used. In this example, the user can grip the training member with a first hand (e.g., dominant hand) for which the training is desired, and grip the overmold/grip with a second hand (e.g., non-use hand). In use, the second hand can remain substantially stationary to provide an anchoring force, and the first hand can rotate the training member in a desired training mode (e.g., rotating the wrist up and down). The target resistance set by the tensioner can provide for a force that needs to be overcome by the user, thereby training strength and coordination for the user, such as increasing grip strength and arm/forearm strength. Further, the resistance can be selectably reduced or increased to accommodate the desired training.

What has been described above includes examples of the claimed subject matter. All details and any described modifications in connection with the Background and Detailed Description are within the spirit and scope of the claimed subject matter will be readily apparent to those of skill in the art. In addition, it should be understood that aspects of the claimed subject matter and portions of various embodiments and various features recited below and/or in the appended claims may be combined or interchanged either in whole or in part. In the foregoing descriptions of the various embodiments, those embodiments which refer to another embodiment may be appropriately combined with other embodiments as will be appreciated by one of skill in the art. Furthermore, those of ordinary skill in the art will appreciate that the foregoing description is by way of example only, and is not intended to limit the claimed subject matter, realizing that many further combinations and permutations of the claimed subject matter are possible. It is, of course, not possible to describe every conceivable combination of components or methodologies for purposes of describing the claimed subject matter, but one of ordinary skill in the art may recognize. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A training apparatus comprising:

a centrally disposed rod comprising a first end, a second end, and a longitudinal axis;

a first tube housing at least a portion of the rod, the first tube extending from the first end of the rod along the longitudinal axis of the rod, and the first tube comprising an inner bearing surface on an inner wall, wherein the inner wall is located proximate the first end of the rod;

a second tube housing at least a portion of the rod, the second tube extending along the longitudinal axis of the rod from the second end of the rod, wherein at least a portion of the second tube is disposed inside the first tube and the first tube and the second tube are elongate tubes;

a selectably compressible grommet disposed within the first tube and on the rod at the first end, wherein the grommet operably contacts the inner wall of the first tube and an outer bearing end of the second tube disposed inside the first tube;

a tensioner element comprising a body that is engaged with the second end of the rod and is in contact with the second tube, wherein the tensioner element is configured such that when it is rotated in a first direction the grommet is compressed between the outer bearing end on the second tube and the first end of the rod, resulting in radial expansion of the grommet away from the longitudinal axis of the rod and toward the inner bearing surface of the first tube, wherein the wall of the first tube applies a normal force against the grommet directed radially inward and the outer bearing end of the second tube applies force along the longitudinal axis of the rod to compress the grommet.

2. The training apparatus of claim 1, further comprising a compression element disposed at the first end of the rod, wherein the compression element operably remains stationary with respect to the first tube and the rod rotates with respect to the compression element when the tensioner element is rotated resulting in the compression of the grommet.

3. The training apparatus of claim 2, the rod comprising a threaded portion at the first end, wherein the compression element comprises a fastener disposed on the threaded portion of the rod, and wherein the fastener operably remains stationary with respect to the first tube and the rod rotates within the fastener when the tensioner element is rotated resulting in the compression of the grommet.

4. The training apparatus of claim 3, wherein the fastener is connected to the inner wall of the first tube at the first end of the rod.

5. The training apparatus of claim 2, wherein the compression element comprises a washer disposed in contact with the grommet.

6. The training apparatus of claim 1, further comprising a mounting clip operably disposed at the first end, the mounting clip comprising a female connector, operably, selectably coupled with a first end of the first tube.

7. The training apparatus of claim 6, wherein the first end of the first tube further comprises a male connector that operably couples with the female connector.

8. The training apparatus of claim 1, further comprising a bearing disposed at the second end of the rod, wherein the bearing is in fixed contact with an interior portion of the second tube to allow the rod to rotate with respect to the second tube.

9. The training apparatus of claim 1 further comprising an overmold portion at least partially disposed on an exterior of the second tube.

10. The training apparatus of claim 1, further comprising a training member shaped and sized to be gripped by a user, wherein the training member is fixedly engaged with a mounting clip that is sized and shaped to operably, selectably mount to the first end of the first tube.

11. The training apparatus of claim 1, wherein the tensioner element is configured such that when it is rotated in a second direction the grommet is decompressed, resulting in radial contraction of the grommet toward the longitudinal axis of the rod and away from the inner bearing surface of the first tube.

12. The training apparatus of claim 1, wherein the inner bearing surface on the inner wall at the first end further comprises a texturized surface.

13. The training apparatus of claim 1, the second tube comprising a second bearing surface disposed proximate to the second end of the rod, the second bearing surface operably in contact with the body of the tensioner element.

14. A training apparatus comprising:

a central rod element comprising a first end and a second end;

a female tube extending along an axis of the central rod element and located at the first end of the central rod element;

a male tube comprising a first bearing surface proximate the first end of the central rod element and extending along the axis of the central rod element at least partially between the first end of the central rod element and the second end of the central rod element wherein the male tube is inserted into at least a portion of the female tube;

a grommet at the first end of the central rod element and disposed inside the female tube, wherein the grommet operably at least partially contacts an interior portion of the female tube;

a compression element on the first end of the central rod element, wherein the compression element is at least partially fastened to the central rod element;

a bearing at the second end of the central rod element, wherein the bearing at least partially contacts an interior portion of the male tube; and a tensioner rotatably attached to the second end of the central rod element and in contact with the bearing, wherein the tensioner is rotated in a first direction thereby compressing the grommet between the male tube and the compression element, resulting in compression of the grommet against an inside wall of the female tube and an outer end of the male tube.

15. The training apparatus of claim 14, further comprising a mounting clip comprising a female connector, operably, selectably coupled with the female tube.

16. The training apparatus of claim 15, wherein the second end of the female tube further comprises a male connector that operably couples with the female connector.

17. The training apparatus of claim 14, further comprising a training member, wherein the training member comprises a training member insert, wherein the training member insert comprises a female connector and is configured for mounting to a first end of a male connector to a mounting clip.

18. The training apparatus claim 14, further comprising a texturized surface on at least a portion of the interior portion of the female tube.

19. A method of using a training apparatus, wherein the training apparatus comprises a centrally disposed rod comprising a first end, a second end, and a longitudinal axis; a first elongate tube housing at least a portion of the rod, the first elongate tube extending from the first end of the rod along the longitudinal axis of the rod, and the first elongate tube comprising an inner bearing surface on an inner wall, wherein the inner wall is located proximate the first end; a second elongate tube housing at least a portion of the rod, the second elongate tube extending along the longitudinal axis from the second end of the rod, wherein at least a portion of the second elongate tube is disposed inside the first elongate tube; a selectably compressible grommet disposed on the rod at the first end and inside the first elongate tube, wherein the grommet operably contacts the inner wall of the first elongate tube; and a tensioner element comprising a body that is engaged with the second end of the rod and in contact with the second elongate tube, wherein the tensioner element is configured such that when it is rotated in a first direction the grommet is compressed between the second elongate tube and the first elongate tube, resulting in radial expansion of the grommet away from the longitudinal axis of the rod and toward the inner bearing surface of the first elongate tube, the method comprising:

rotating the tensioner element in the first direction thereby increasing an amount of friction between the grommet and the inner bearing surface;

coupling a training member to a first end of the first elongate tube; and rotating the training member with a first hand while holding the second elongate tube with a second hand.

20. The method of claim 19, rotating the tensioner element in a second direction thereby decreasing the amount of friction between the grommet and the inner bearing surface.

* * * * *